US005882011A

United States Patent [19]

Praria

[11] Patent Number: 5,882,011

[45] Date of Patent: Mar. 16, 1999

[54] BOARD GAME REQUIRING INSTANT COMPLEX DECISIONS AND IMMEDIATE COMPETITIVE ACTION

[76] Inventor: Guy B. Praria, 14 George St., Wayland, Mass. 01778

[21] Appl. No.: 775,282

[22] Filed: Dec. 31, 1996

[51] Int. Cl.[6] ..... A63B 67/00

[52] U.S. Cl. ..... 273/445; 273/454; 273/237; 463/7; 463/37

[58] Field of Search ..... 273/445, 454, 273/455, 460, 237; 463/7; 434/258

[56] References Cited

U.S. PATENT DOCUMENTS 4,261,563 4/1981 Goldfarb ..... 273/445 X
4,285,517 8/1981 Morrison ..... 273/454 X
4,309,030 1/1982 Goldfarb et al. ..... 273/445 X
4,339,135 7/1982 Breslow et al. ..... 463/7
4,770,416 9/1988 Shimizu et al. ..... 273/454 X

*Primary Examiner*—Michael O'Neill

[57] ABSTRACT

An action board game in which each player tries to be first to respond correctly to command indicators activated in a random sequence and at indeterminate times. Players try to be first to use the correct hand to operate a control matching the command indicator. Various levels of play can be selected ranging from matching colors to the equivalent of simultaneously playing multiple games of ping-pong. Players can participate as individuals or as teams.

8 Claims, 11 Drawing Sheets

BOARD GAME REQUIRING INSTANT COMPLEX DECISIONS AND IMMEDIATE COMPETITIVE ACTION

BACKGROUND

1. Field of the Invention

This invention relates to board games specifically to games in which each player tries to be first to respond properly to various commands given at random times.

2. Discussion of Prior Art

Heretofore, board games have been far more dependent on luck than skill. They are usually played by each player, in turn, rolling a die or dice, some with 20 or more faces, or by spinning a pointer, or in some other way determining a move purely on the basis of luck. In such games the skill of the player is of little or no importance. What competition there is generally amounts to determining which player has the best memory. When decisions are required there is usually adequate time to make them; there is no requirement to make them quickly or before another player does.

Prior art board games usually required either minimal motion such as moving a marker a number of squares selected by luck, or required continued frantic action with no thought involved. Such board games usually required players to take turns moving a marker a random number of positions or to take some minor action such as answering a question, drawing a picture, singing a tune, etc., as determined by spinning a pointer or rolling a die or dice. Decisions and actions can take as long as the other players are willing to wait. Physical effort is minimal and the greatest required mental attribute appears to be patience. Competition comes only from comparing the results of each player individually attempting a low energy task.

OBJECTS AND ADVANTAGES

Accordingly, an object of this invention is to provide a game of skill in which complex decisions must be made instantly, at the time they are called for, requiring each player to first determine whether to respond, then determine what response is required, then determine how to respond, and then to respond completely and correctly; all in a fraction of a second.

Further objects of this invention are:

(A) to provide a game of skill in which sudden physical action is required.

(B) to provide a game of skill in which a signal for action is given to all players simultaneously.

(C) to provide a game of skill in which all players compete for each move.

(D) to provide a game of skill in which a signal for action is given to all players at indeterminate times.

(E) to provide a game of skill in which all players start from equal starting positions.

(F) to provide a game of skill in which different responses are required at different times.

(G) to provide a game of skill in which different methods of responding are required.

(H) to provide a game of skill in which, occasionally, a lack of response is required.

(I) to provide a game of skill which has various levels of play.

(J) to provide a game of skill in which players can compete as individuals or as teams.

(K) to provide a game of skill in which luck is essentially not a factor.

Further objects and advantages of my invention will become apparent from a consideration of the drawings and ensuing description.

LIST OF REFERENCE NUMERALS IN DRAWINGS

8 game board 10A,B,C,D players' sections

12R,Y,G,B scoring holes 14L,R ready switches

16R,Y,G,B response switches 18A,B,C,D response indicators

20 electronics package 21 circuit board

22 power source 23 connecting wires

24 enclosure 26R,Y,G,B command indicators

Figure 1A:
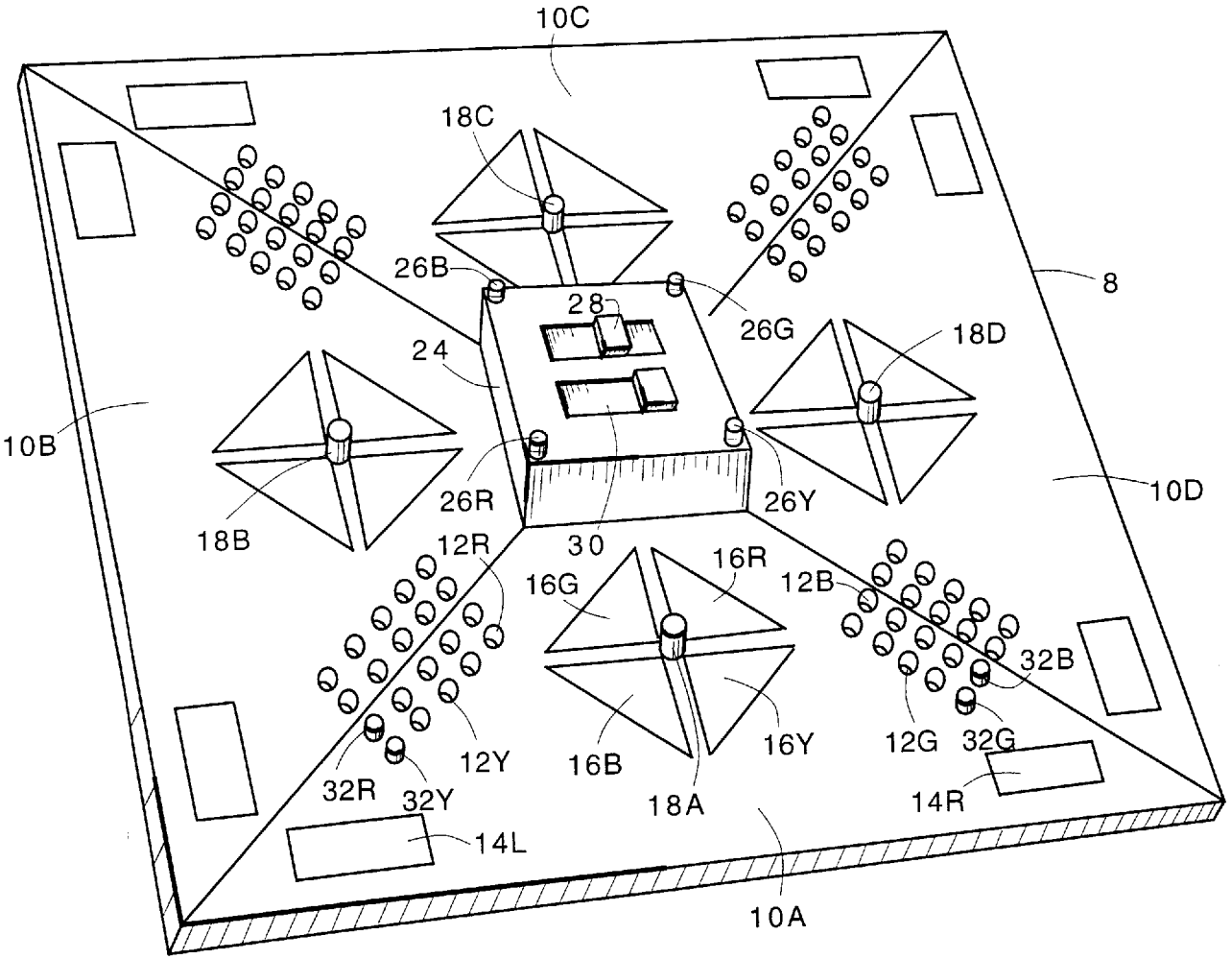
FIG. 1A is a perspective view of my game showing one arrangement of switches and indicators.

28 power/game level selector switch 30 singles/doubles switch

32R,Y,G,B scoring pegs

SUMMARY

With my game, complex decisions must be made instantly at the time they are called for. Action commands are given at random times with all players given the same command at the same time. Players do not take turns but compete for every move. They are not given commands individually with plenty of time to think about it.

This game requires instant physical action preceded by recognition of a changing situation, a decision to act, a decision as to what action to take and how to take it, and the physical speed and coordination to complete the action before another player does. My game requires all players to be attentive, to recognize when, if, and how action is to be taken, to decide what action is to be taken, and to take such action before another player does. This requires speed of thought as well as speed of motion. It also requires concentration and coordination. The enjoyment of the game comes from the quick decisions, the sudden actions, and the excitement of direct competition.

DESCRIPTION OF THE PREFERRED EMBODIMENT

This invention is an action board game comprising a plurality of identical players' sections arranged around a central enclosure with each player's section containing one or more ready switches, multiple response switches, a response indicator, and a scoring means such as a series of pegs and holes.

The central enclosure contains a power source, electronics circuitry, a plurality of command indicators, a singles/double switch and a power/game level selector switch. The command indicators are coordinated with the response switches and are placed so as to be equally visible to all players. The electronic circuitry is wired so that, when all players close their ready switches, a command indicator will be energized randomly, requiring all players to try to be first to touch their response switches corresponding to the energized command indicator. The circuitry will energize the response indicator in the player's section first having the correct response allowing that player to advance his or her marker. The circuitry is then reset and the next round is started.

Physical Description;

This invention comprises a game board of wood, pasteboard, plastic or other suitably rigid material, of sufficient size to be divided into identical players' sections arranged around a central enclosure with each section large enough to accommodate a series of switches, a response indicator, and a scoring means such as a series of pegs and holes.

Along the outer edge of each player's section are two ready switches, spaced far enough apart that they cannot be operated with one hand. Toward the center of each section are a plurality of response switches and a response indicator.

The central enclosure contains the power source, the electronics package, a plurality of command indicators, the singles/double switch and the power/game level selector switch. The electronics package in this embodiment comprises an erasable programmable logic device (EPLD). Discrete components could also be used; however when produced in large quantities an application specific integrated circuit (ASIC) would most likely be used. The command indicators are coordinated with the response switches and are placed so as to be equally visible to all players.

As seen in FIG. 1A, a game board 8 is divided into four identical players' sections 10A, 10B, 10C, and 10D around an enclosure 24 formed in the center of game board 8.

Figure 1B:
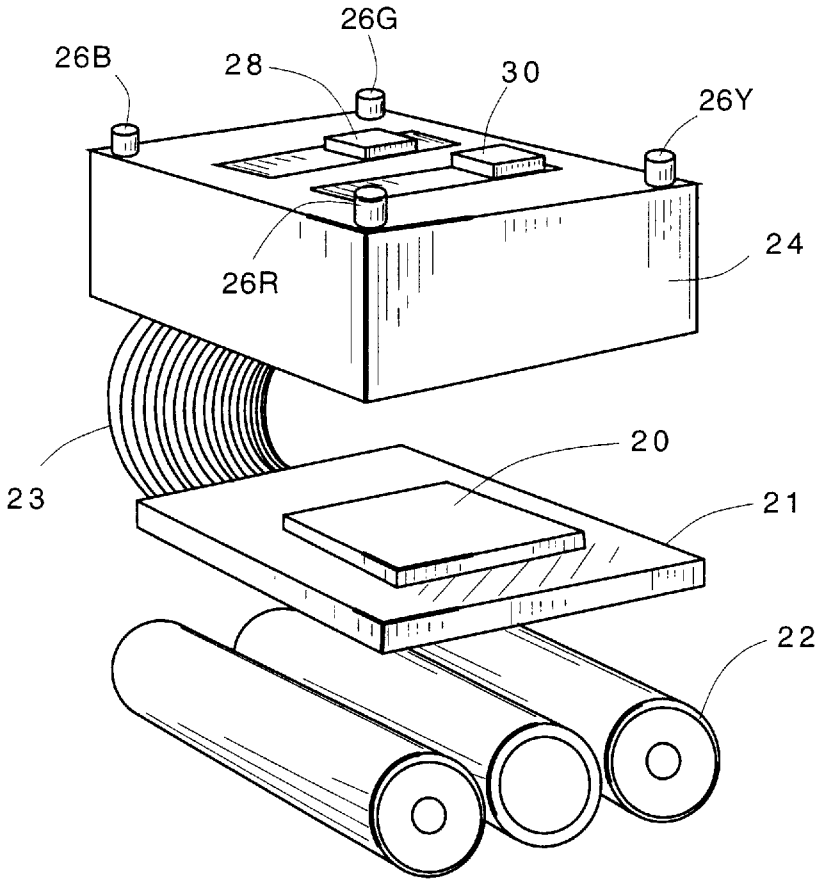
FIG. 1B is an exploded view of the central enclosure.
Figure 2:
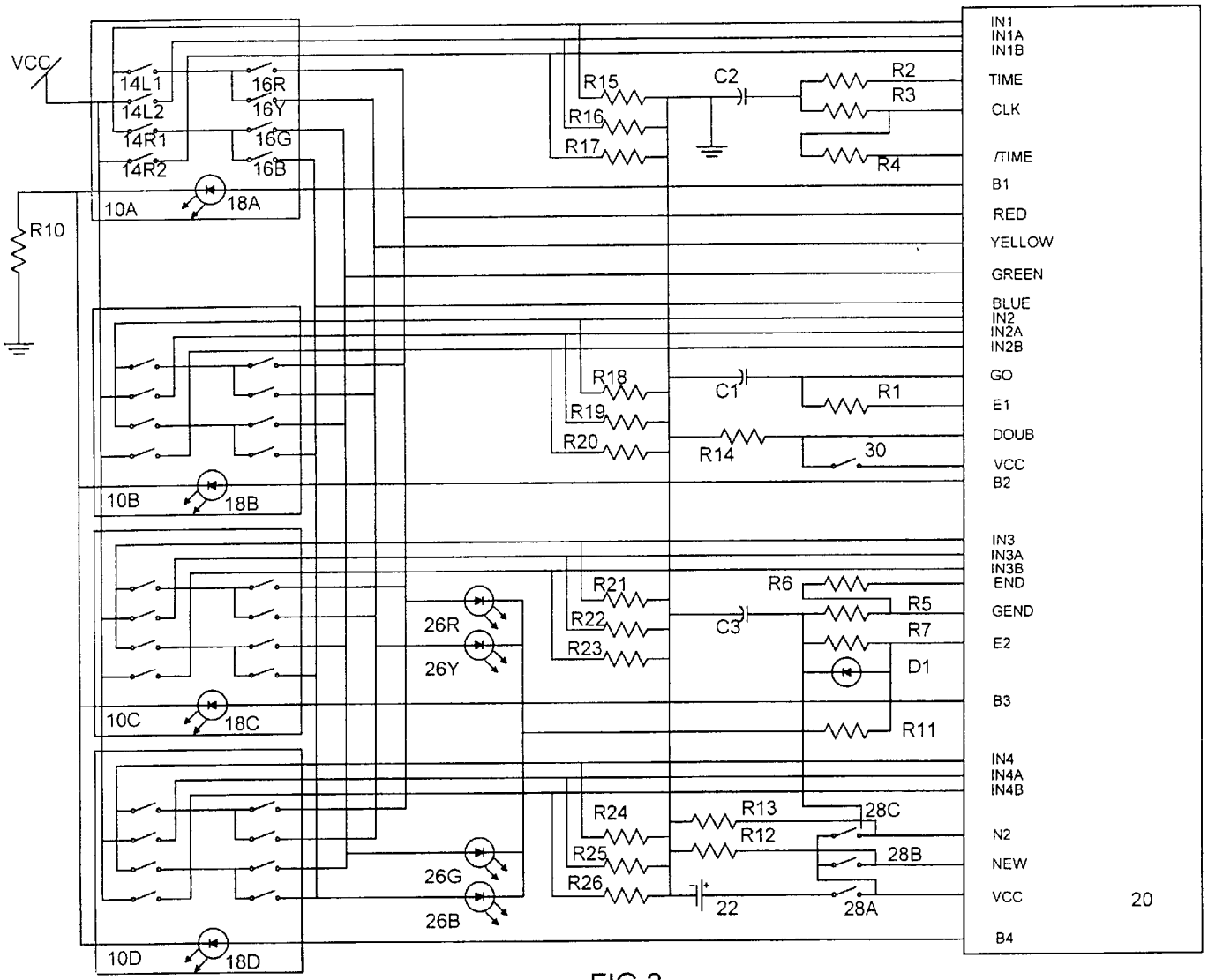
FIG. 2 is a wiring diagram showing interconnections among sections and the electronics package.

FIG. 1B is an exploded view of enclosure 24 showing an electronics package 20 mounted on a circuit board 21 containing the resistors, capacitors, and a diode (shown in FIG. 2). Also shown are a power source 22—in this case three AA dry cells—and interconnecting wiring 23.

Four command indicators comprising four light emitting diodes (LEDs), one red 26R, one yellow 26Y, one green 26G, and one blue 26B are mounted on the corners of enclosure 24. A four position power/game level selector switch 28 and a two position singles/doubles switch 30 are mounted on top of enclosure 24.

The four identical players' sections 10A, 10B, 10C, and 10D are defined by a row of red scoring holes 12R and a row of yellow scoring holes 12Y on the left hand side of each section 10A, 10B, 10C, and 10D, and a row of green scoring holes 12G and a row of blue scoring holes 12B on the right hand side of each section 10A, 10B, 10C, and 10D. Four scoring pegs 32R, 32Y, 32G, and 32B are provided for each section. Because the four players' sections are identical only one section, 10A, will be described. The others are identical in performance as well as appearance.

Figure 1C:
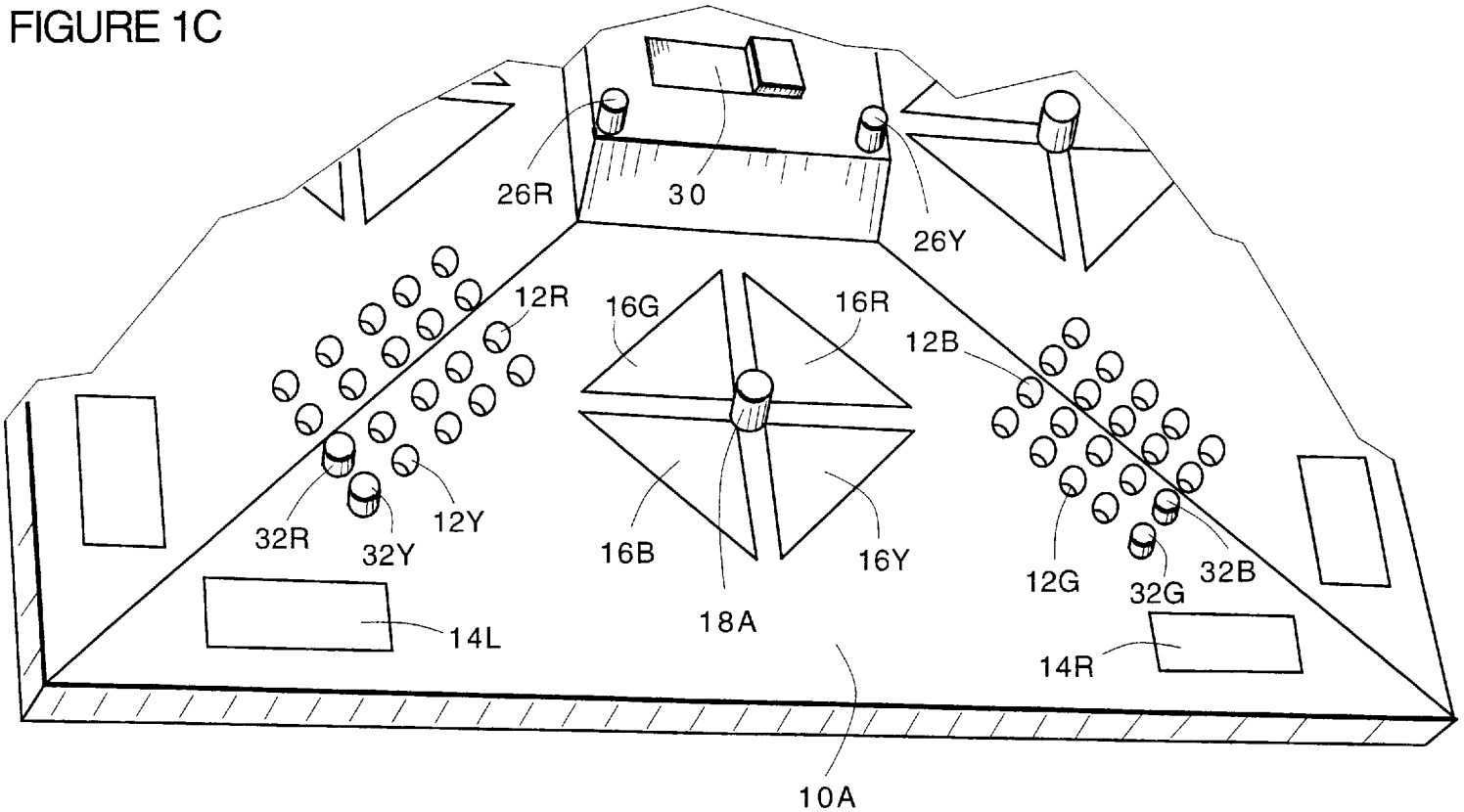
FIG. 1C shows player's section 10A.

As seen in FIG. 1C, section 10A of game board 8 contains four rows of scoring holes 12R, 12Y, 12G, and 12B, two double pole, single throw, normally open "ready" switches 14L and 14R, four single pole, single throw, normally open "response" switches 16R, 16Y, 16G, and 16B and a response indicator 18A. Response indicator 18A comprises an orange LED located in the center of the array of response switches 16R, 16Y, 16G, and 16B.

Ready switches 14L and 14R are at the outer edge of board 8 and spaced far enough apart that the player can't operate both switches with one hand. Response switches 16R, 16Y, 16G, and 16B are colored red, yellow, green, and blue, respectively, and are spaced as far away from ready switches 14L, and 14R as practicable.

Ready switches 14L and 14R and response switches 16R, 16Y, 16G, and 16B are touch switches comprising two adjacent but non-contacting conductors beneath a conducting pad spaced slightly above them. When the conductive pad is pressed down against them the conductors are shorted together closing the switch. Since such switches are common in electronics and their construction is not a part of this invention the physical construction need not be shown, therefore they are shown as symbols. Similarly, the four position power/game level selector switch 28 can be a slide switch or a rotary switch wired to perform the functions described. Such wiring is well within the abilities of one skilled in the art.

CONTROL CIRCUITRY

The wiring diagram in FIG. 2 shows the interconnections between the various elements of the game. Again describing section 10A, (shown in the box labeled 10A in FIG. 2) one contact of pole #1 of switch 14L (the left hand ready switch) is connected to one contact of pole #1 of switch 14R (the right hand ready switch) and to input IN1 of electronics package 20. The other contact of pole #1 of switch 14L is connected to one contact of response switch 16R and to one contact of response switch 16Y. The other contacts of switches 16R and 16Y are connected to outputs RED and YELLOW respectively of electronic package 20. In the same way, the other contact of pole #1 of switch 14R is connected to one contact of response switch 16G and to one contact of response switch 16B. The other contacts of switches 16G and 16B are connected to outputs GREEN and BLUE respectively of electronic package 20.

One contact of pole #2 of switch 14L is connected to the corresponding contact of pole #2 of switch 14R and to VCC. The other contact of pole #2 of switch 14L is connected to input IN1A of electronics package 20. In the same way, the other contact of pole #2 of switch 14R is connected to input IN1B of electronics package 20.

The anode of response indicator 18A is connected to output B1 of electronic package 20. The cathode of response indicator 18A is connected to the cathodes of the other response indicators 18B, 18C, and 18D in the other players' sections 10B, 10C, and 10D and to common through current limiting resistor R10.

As can be seen in FIG. 2, connections IN1, IN1A, IN1B, and B1 for section 10A become, respectively: IN2, IN2A, IN2B and B2 for section 10B; IN3, IN3A, IN3B, and B3 for section 10C; and IN4, IN4A, IN4B and B4 for section 10D. Outputs RED, YELLOW, GREEN, and BLUE of electronic package 20 are connected to the anodes of command indicator LEDs 26R, 26Y, 26G, and 26B respectively. The cathodes of LEDs 26R, 26Y, 26G, and 26B are connected to output E2 of electronics package 20 through current limiting resistor R11. Electronics package 20 inputs NEW, N2, DOUB, IN1, IN1A, IN1B, IN2, IN2A, IN2B, IN3, IN3A, IN3B, IN4, IN4A, and IN4B are connected to common through pull down resistors R12 through R26 respectively.

When the game is being played power source 22, comprising three AA dry cells in series, is connected to VCC of electronic package 20 through pole A of switch 28. Inputs NEW and N2 of electronic package 20 are connected to the normally open contacts of poles B and C respectively of switch 28. The arm of switch 28B and the arm of switch 28C are connected to VCC.

Output E2 is connected to the junction of resistor R5 and capacitor C3 through resistor R7 in parallel with diode D1. The anode of diode D1 is connected to output E2; the cathode of diode D1 is connected to the junction of resistor R5 and capacitor C3. The junction of resistor R5 and capacitor C3 is connected to VCC through the normally closed contact of switch 28C.

Input GEND is connected to output END through resistor R6. Input GEND is connected to common through resistor R5 and capacitor C3 in series.

Input DOUB is connected to common through resistor R14 and to the arm of singles/doubles switch 30. The normally open contact of switch 30 is connected to VCC.

Output E1 is connected to input GO through resistor R1. Input GO is connected to common through capacitor C1.

Output /TIME is connected to input CLK through resistor R4. Output TIME is connected to common through resistor R2 and capacitor C2 connected in series. The junction of resistor R2 and capacitor C2 is connected to input CLK through resistor R3.

OPERATION

Initial conditions;

For all levels of play, input DOUB: high for individual play, low for doubles play.

Game level one:

Input NEW low; input N2 low;

Game level two:

Input NEW high; input N2 low;

Game level three:

Input NEW high; input N2 high;

Rules of the game;

All levels of play start with all players placing one hand on one ready switch to log on and the other hand on the other ready switch to start the game. This assures each player of equal opportunity in the game. Touching either ready switch in a section activates that section. Touching both ready switches enables that section. The first ready switch closed activates the clock. When all sections that have been activated are also enabled (ready switches closed in pairs) the GO circuit is enabled.

Shortly after the GO circuit is enabled the GO input will go high. The time delay will vary from milliseconds to about a second depending on the time elapsed between rounds. When GO is enabled it lights one of the command indicator LEDs. This also activates the corresponding response switch in each section. Each player then tries to be first to respond properly by touching his or her response switch corresponding to the illuminated command indicator. The individual sections are wired so that the player must use his right hand to operate red and yellow switches and his left hand to operate green and blue switches. In either case the player's other hand must remain on the other ready switch. If both hands are lifted off both ready switches the player's section is deactivated. The board is reset by all players removing both hands from the ready switches.

At the first level of play one of the command indicator LEDs will be lit shortly after all players have energized both ready switches. Each player must then determine which color command indicator LED is lit. If it is red or yellow the player must keep his left hand on the ready switch and touch the proper (red or yellow) response switch with his right hand. If it is green or blue the player must keep his right hand on the ready switch and touch the proper switch (green or blue) with his left hand. If the wrong hand is used or if it is inadvertently lifted from the ready switch the player's response switch will be disconnected. The response indicator LED of the first player to touch the correct switch with the correct hand will light. That player then moves a marker forward one space in the row that is the same color as the command indicator LED. The first player to get all markers to the ends of the rows wins. If the command indicator LED is a color that a player already has at the end of his or her row the player does not get to move if he or she is first to touch the right switch. He or she should still try, however, to prevent the other players from getting it.

The second level operates in the same way as the first level except that occasionally one of the players will be given the move automatically. If he or she accepts it his or her response light will stay on and he or she can move the appropriate marker. If he or she inadvertently moves either hand his or her response light will go out, he or she will be latched out of play, and the first of the other players to take the correct action will get the move. All players must be ready to respond because a player is selected automatically 50% of the time at most. If a player waits too long to determine whether a move has been awarded, another player could respond first. If, however, he or she is too anxious and starts to respond before noticing that his response LED is lit he will be latched out and the move will go to another player.

The third level is played in a somewhat different manner. At this level a player is always selected and the player must respond quickly to avoid the count. A command LED will light shortly after all players have closed both of their ready switches. In addition, one player's response LED will be lit. That player must respond promptly before a time out. If he or she does, his or her response LED will go out and another response LED will be lit. This may be the same or a different player's response LED. The player whose response LED is lit must then respond quickly. If the player does not respond quickly enough his or her response LED will be latched in and he or she must move his or her marker one space in the row that is the color of the command indicator LED. As each player gets all his or her markers to the ends of his or her rows he or she is eliminated from the game. The player remaining is the winner. This game is much like playing two or more simultaneous games of Ping Pong.

In doubles play both players of a team must respond correctly to get the move. Played at level one, both players of a team must touch the correct switch with the correct hand before both players of the other team touch the correct switch with the correct hand. The response indicators for both players will light for the winning team.

Circuit Description:

One half of ready switches 14L and 14R for each players section 10A, 10B, 10C, and 10D (FIG. 2) are connected to inputs IN1A, IN1B, IN2A, IN2B, IN3A, IN3B, IN4A, and IN4B respectively of the block labeled LOGON (FIG. 38). This block determines which players' sections are being used and whether one or both ready switches in a players section are closed. When any one of inputs IN1A through IN4B is pulled high LOGON output CEN will go high. This will enable AND gate U65 (FIG. 3A) to start the clock circuit.

The clock input, CLK, to the block SEQUEN (FIG. 3A) causes outputs D1 through D4 to go high sequentially for two clock periods each. Outputs RED, YELLOW, GREEN, and BLUE go high sequentially for each sequence of D1 through D4 (RED goes high for one sequence, BLUE goes high for one sequence, etc.). The sequence stops when input E2 goes low.

Figure 3A:
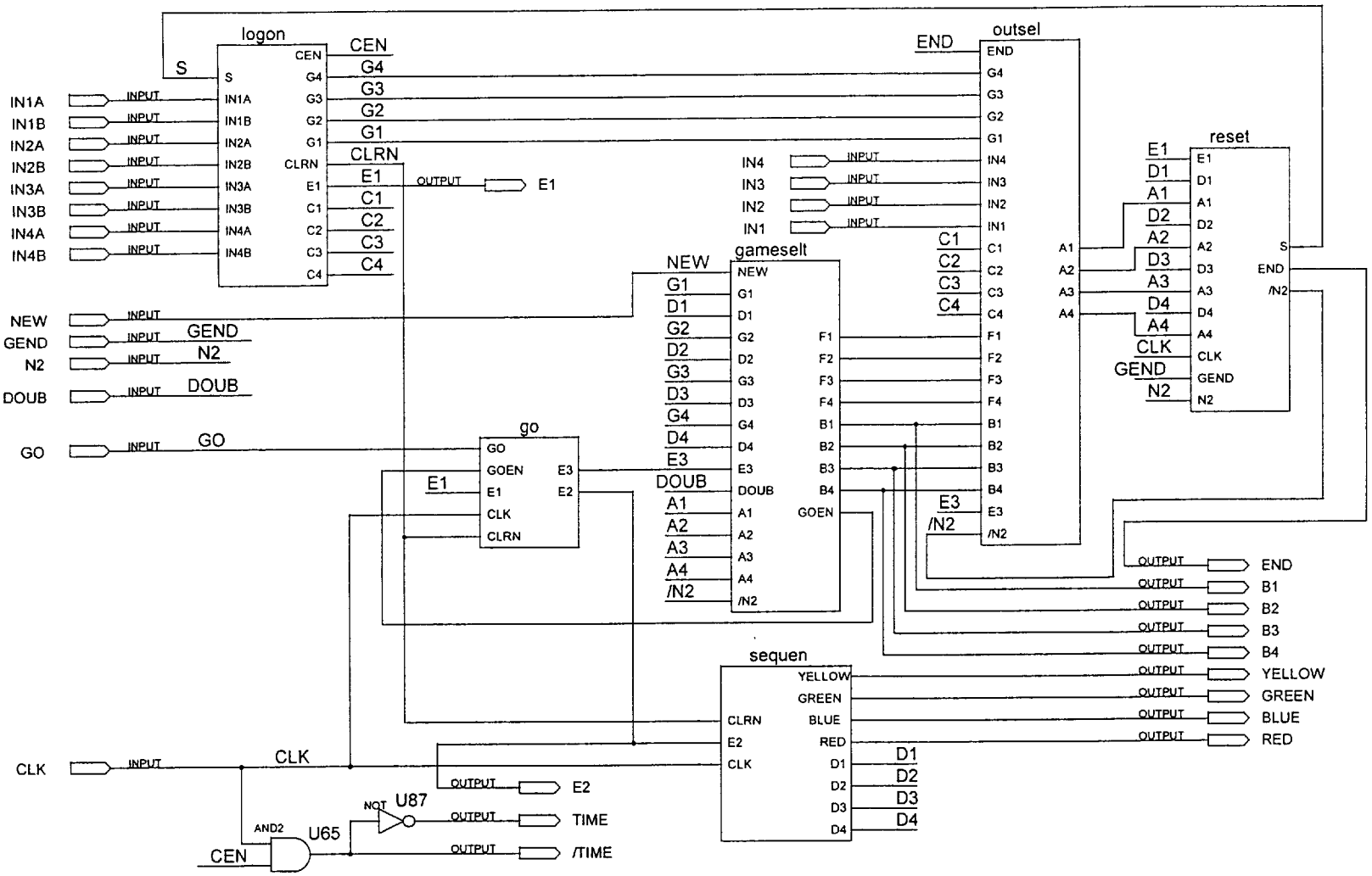
FIG. 3A is a block diagram of the electronics package.

When inputs IN1A through IN4B are pulled high in pairs (both A and B are high) LOGON output E1 will go high to enable clock pulses to the GO circuit (FIG. 3A).

With GOEN normally high, a high on input GO will latch output E3 high and output E2 low. Output E2 stops the command indicator and player sequencers (in block SEQUEN). Output E3 enables OUTSEL for all game levels and GAMESELT in levels two and three. A correct response from a player's section will then latch in the response indicator on that section.

Ready circuits:

Describing section 10A, ready switches 14L and 14R perform several functions. They 'log on' the section; that is either switch closed lets electronics package 20 know that section 10A is active. Both switches closed enables section 10A to let the electronics know that the player is ready, and they enable response switches 16R, 16Y, 16G, and 16B in pairs, so that the player is required to use the correct hand to respond.

One contact of the second pole of each of ready switches 14L and 14R is connected to VCC. The other contact of the second pole of 14L is connected to input IN1A of electronics package 20. The other contact of the second pole of 14R is connected to input IN1B of electronics package 20. When either ready switch 14L or 14R is operated it places a high on the corresponding input and on signal CEN (output of block LOGON in FIG. 3A). With signal S (output of block RESET in FIG. 3A) normally high, signal CLRN (output of block LOGON) will go high allowing block GO and block SEQUEN to operate whenever they are enabled.

If only one ready switch (14L or 14R) of player's section 10A is operated it will cause a high on signal C1 (an output of block LOGON). This will prevent signal E1 (the output of U50 in block LOGON) from going high. If neither or both of ready switches 14L or 14R are operated signal C1 will not go high and, therefore, will not inhibit U50. When all ready switches that are activated are activated in pairs, signal E1 will go high enabling the clock pulse (through U86 in block GO) for latch U0. (in block GO).

Figure 3B:
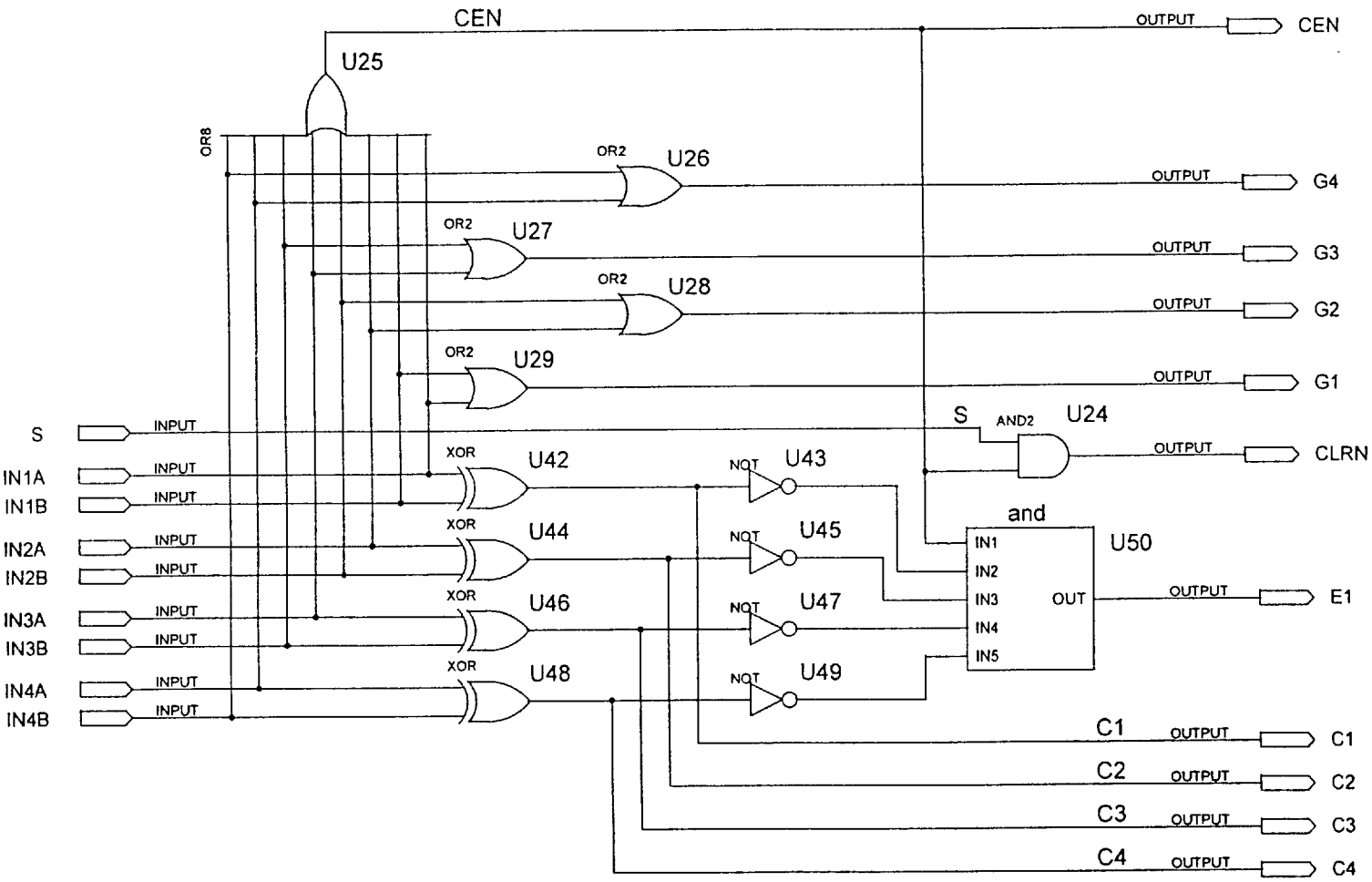
FIG. 3B is a circuit diagram of block LOGON.

LOGON Circuit (FIG. 3B):

The LOGON circuit determines which players' sections are active and whether one or both ready switches are closed.

With none of inputs IN1A through IN4B high output CEN and consequently outputs CLRN and E1 will be low. Output CLRN is used to clear the GO latch, the Player Sequencer and the Command Indicator Sequencer. The Player Sequencer and Command Indicator Sequencer are included in block SEQUEN. Output E1 is used to enable the GO latch and preset the RESET circuit.

Any of inputs IN1A through IN4B going high will bring output CEN high and the corresponding G output high. Outputs G1, G2, G3, and G4 identify a player's section (10A, 10B, 10C, and 10D respectively) as being active.

If only the A or the B input of inputs IN1A, IN1B (or IN2A, IN2B or IN3A, IN3B or IN4A, IN4B) is high the corresponding C1 through C4 output will go high and output E1 will be low. If both A and B inputs of IN1A, IN1B (or IN2A, IN2B or IN3A, IN3B or IN4A, IN4B) or neither A or B input is high the corresponding C1 through C4 output will be low. Outputs C1 through C4 are used to indicate that a player has closed one and only one ready switch. When C1, C2, C3, and C4 are all low and CEN is high output E1 will go high.

With input S normally high all of inputs IN1A through IN4B must be low to bring output CLRN low.

Clock Pulse Generator (FIG. 2 and FIG. 3A):

Input CLK is gated with signal CEN by U65. The output of U65 goes directly to output /TIME and, after being inverted by U87, to output TIME. Clock pulses are provided by connecting input CLK of electronics package 20 through resistor R3 to an RC delay circuit (resistor R2 and capacitor C2) from output TIME as shown in FIG. 2. Resistor R4, from output /TIME to input CLK, and resistor R3, from the junction of resistor R2 and capacitor C2 to input CLK, provide hysteresis.

Output TIME is normally high making input CLK high. When ready switch 14L or 14R of section 10A (for instance) is closed it puts a high on input IN1A or IN1B (depending on which is closed). This brings signal CEN (FIG. 3A) high and, with signal CLK high, brings the output of U65 high to bring output /TIME high.

At the same time (when the output of U65 goes high), output TIME goes low discharging capacitor C2 (FIG. 2) through resistor R2. The voltage on input CLK will ramp down until it reaches the maximum off threshold of the device. At that point, output /TIME will go low pulling input CLK lower and output TIME will go high. Capacitor C2 will start to charge through R2. When the charge on C2, divided by R3/R4, exceeds the minimum on threshold of the device, input CLK going high will bring output /TIME high to pull input CLK higher, providing a clock pulse for the Player and Command Indicator Sequencers (in block SEQUEN). Output TIME will go low again to start the cycle over.

Figure 3C:
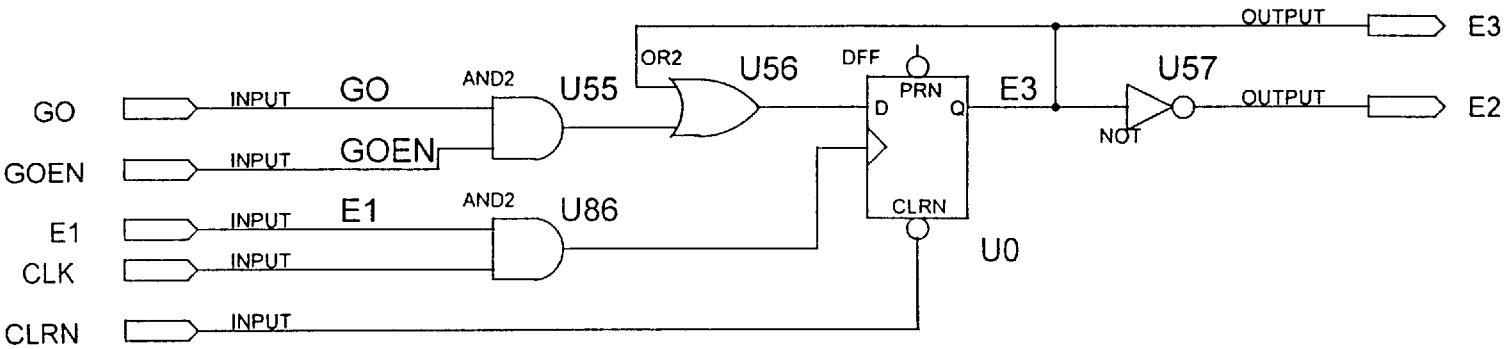
FIG. 3C is a circuit diagram of block GO.

GO Circuit (FIG. 3C):

As shown in FIG. 2, output E1 is externally connected (through resistor R1) to input GO. Input GO is connected, through capacitor C1, to common. When output E1 goes high capacitor C1 charges through resistor R1. At game level one, input N2 will be low making the output GOEN of block GAMESELT (FIG. 3A) high and enabling U55 of block GO. Input N2 is inverted by U63 in block RESET and fed to blocks OUTSEL and GAMESELT. When the charge on capacitor C1 (FIG. 2) exceeds the minimum high input threshold of U55 (FIG. 3C) the output of U55 will go high. The next clock pulse (gated through U86 of block GO) will then clock a high to signal E3 (output of latch U0 of block GO). This will enable latches U12 through U15 of block OUTSEL (FIG. 3F) and bring signal E2 low to hold latches U1 through U11 of block SEQUEN (FIG. 3E) in whatever state they have reached.

Before U0 is enabled its output, signal E3, is low making signal E2 (output of U57 in FIG. 3C) high. This enables U1 through U11 (by way of U85 in FIG. 3E) and allows the Command Indicator and Player Sequencers to operate.

Game Selector (GAMESELT FIG. 3D):

Game level one;

With input NEW low outputs F1, F2, F3, and F4 will be low. The output of XOR gates U67, U69, U71, and U73 will then depend on inputs A1, A2, A3, and A4 respectively (the response latches in block OUTSEL). With input DOUB high, AND gates U80, U81, U82, and U83 will have one input high. Outputs B1, B2, B3, and B4 will then follow inputs A1, A2, A3, and A4. If input /N2 is high GOEN will be high to allow a GO pulse. If input /N2 is low GOEN will go high only when a player is selected. Input /N2 is high in game levels one and two.

Game level two;

Input NEW is high in game levels two and three. With input NEW high outputs F1, F2, F3, or F4 will go high when input E3 goes high and both G1D1, G2D2, G3D3, or G4D4 respectively are high. Inputs G1, G2, G3, and G4 will go high when either or both ready switches in a players section are closed. Inputs D1, D2, D3, and D4 will go high sequentially as selected by the Player Sequencer. This will cause F1, F2, F3, or F4 to go high randomly to select one player and lock out the others when input E3 goes high. If that player responds the corresponding A1, A2, A3, or A4 will go high to deselect that player and enable the others.

Game level two is selected by bringing input NEW high with input N2 low. All circuits function as in game level one except that U66, U68, U70, and U72 are enabled whenever signal E3 goes high. As a result, a GO input will cause one of the outputs (RED, YELLOW, GREEN, or BLUE) to go high and, as much as 50% of the time, will also cause one player to be selected by the Player Sequencer.

Closing either ready switch 14L or 14R of section 10A brings signal G1 (output of U29 in FIG. 3B) high. Closing either ready switch 14L or 14R in sections 10B, 10C, or 10D causes the corresponding G signal (G2, G3, or G4) to go high. When a GO input causes signal E3 to go high with an even number latch (U6, U8, or U10 in FIG. 3E) of the Player Sequencer high, no player will be selected. If signal E3 goes high with an odd number latch (U5, U7, U9, or U11) high and the corresponding G signal high, a player will be selected. A D and a corresponding G input to AND gates U66, U68, U70, or U72 will cause the corresponding F input to the XOR gates (U67, U69, U71, or U73) to go high. With input DOUB high that player's response LED will be lit giving him or her the count and preventing any of the other players from getting it. If, however, the player allowed the count lifts his or her hand from either ready switch the corresponding C output (C1, C2, C3, or C4) of U42, U44, U46, or U48 (FIG. 3B) will go high and his or her output selector will latch in. This will bring the other input to the XOR gate high to lock him or her out and enable all the other players. All players must be ready to respond each time a command indicator is energized because the Player Sequencer does not always select a player.

Figure 3D:
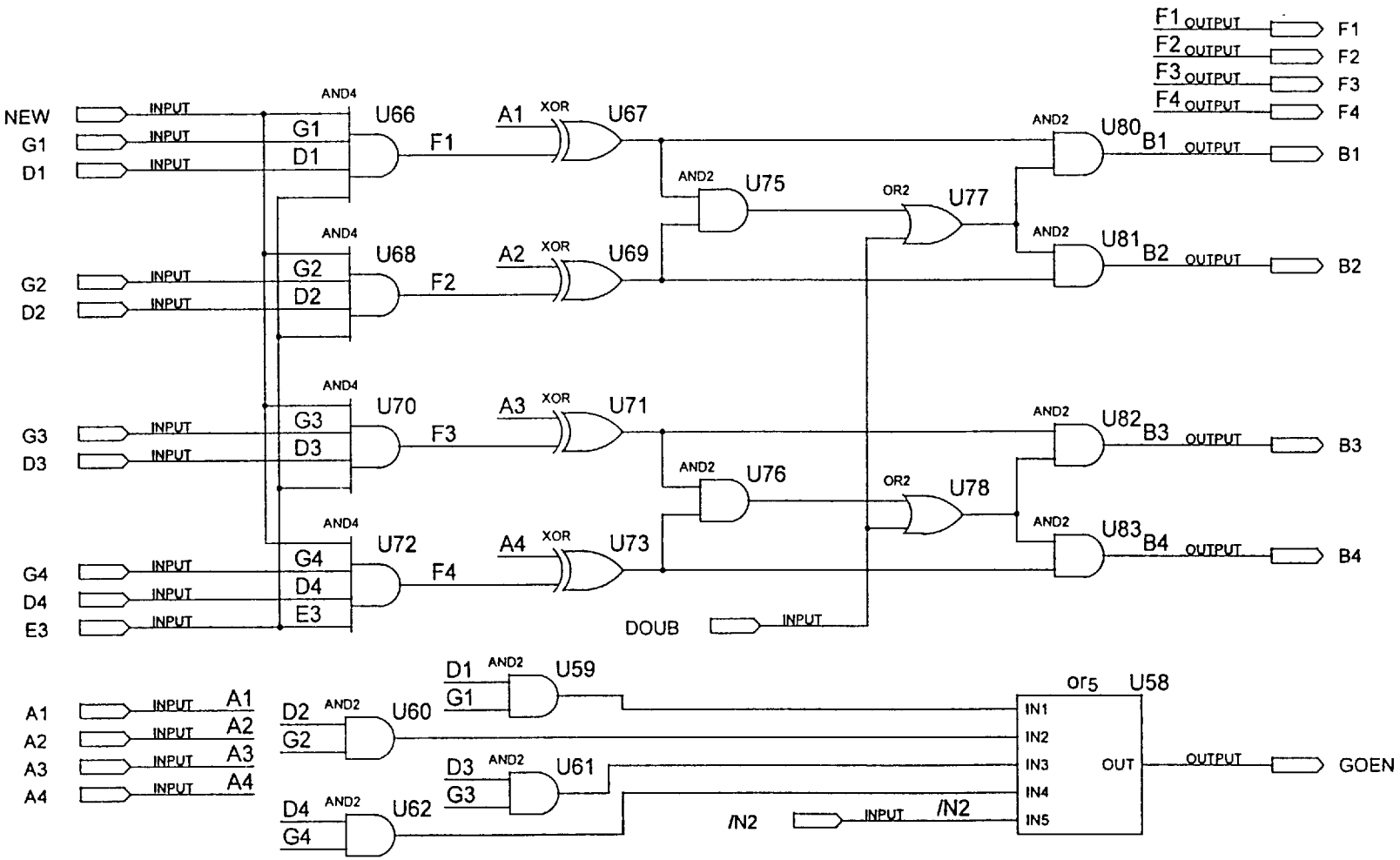
FIG. 3D is a circuit diagram of block GAMESELT.

Game level three;

Game level three is similar to game level two except that the Player Sequencer always selects a player. This is accomplished by AND gates U59 through U62 (FIG. 3D) and inverter U63 (FIG. 3G). In game levels one and two input N2 is held low through resistor R13 (FIG. 2). This holds one input to OR gate U58 high (FIG. 3D) making output GOEN high. Selecting game level three pulls input N2 high through switch 28C (FIG. 2) bringing the /N2 input to U58 low. Switch 28C also removes VCE from capacitor C3 allowing it to discharge through resistor R7 when output E2 goes low. To bring the output of OR gate U58 high both a D and a corresponding G signal must be high. This, then, prevents a GO input from setting latch U0 (FIG. 3C) until the Player Sequencer selects a player that has at least one ready switch closed.

When both a player and a command indicator LED have been selected and capacitor C1 has charged through resistor R1 a GO input will be clocked into latch U0 (FIG. 3C) making signal E3 high and signal E2 low. Capacitor C3 will then start to discharge through resistor R7. If the player selected does not respond quickly signal GEND will go low bringing signal END low to keep his response indicator 18 energized and prevent any further action until the game is reset. Resistor R6 provides hysteresis.

If the player responds in time, opening one of his or her ready switches causes signal E1 to go low discharging capacitor C1 through resistor R1 and presetting U16 and U17 (FIG. 3G). If the correct ready switch is held closed and the correct response switch is closed the response indicator will be latched out and an A input matching a D input to AND gate U18, U19, U20, or U21 will put a high on the output of OR gate U22. When the player then re-closes his or her ready switch signal E1 will go high making all inputs to NAND gate U23 high thereby making signal S low. With signal S low signal CLRN (output of AND gate U24 in FIG. 3B) will go low to reset all latches. (Signal S will be held low by inverter U79 in FIG. 3G.) Two clock pulses later the output of U17 will go low bringing signal S and thereby signal CLRN high to restart the sequence.

Singles/Doubles;

With singles/doubles switch 30 closed (FIG. 2) input DOUB to electronics package 20 is pulled high making one input to AND gates U80, U81, U82, and U83 (FIG. 3 D) high. A single A input to XOR gate U67, U69, U71, or U73 will bring the B output of the corresponding AND gate U80, U81, U82, or U83 high to energize a response indicator. When singles/doubles switch 30 is opened, either A1 and A2 or A3 and A4 must go high together to energise the corresponding response indicators. The response of a single player, then, will energize a response indicator with switch 30 closed, while with switch 30 open the correct response from both players on a team is required and will energize both response indicators. With input DOUB low U75 must go high to enable U82 and U83 and U76 must go high to enable U82 and U83. Therefore, outputs B1 and B2 will go high only when both inputs A1 and A2 go high and outputs B3 and B4 will go high only when inputs A3 and A4 go high. This requires players to act as teams.

Figure 3E:
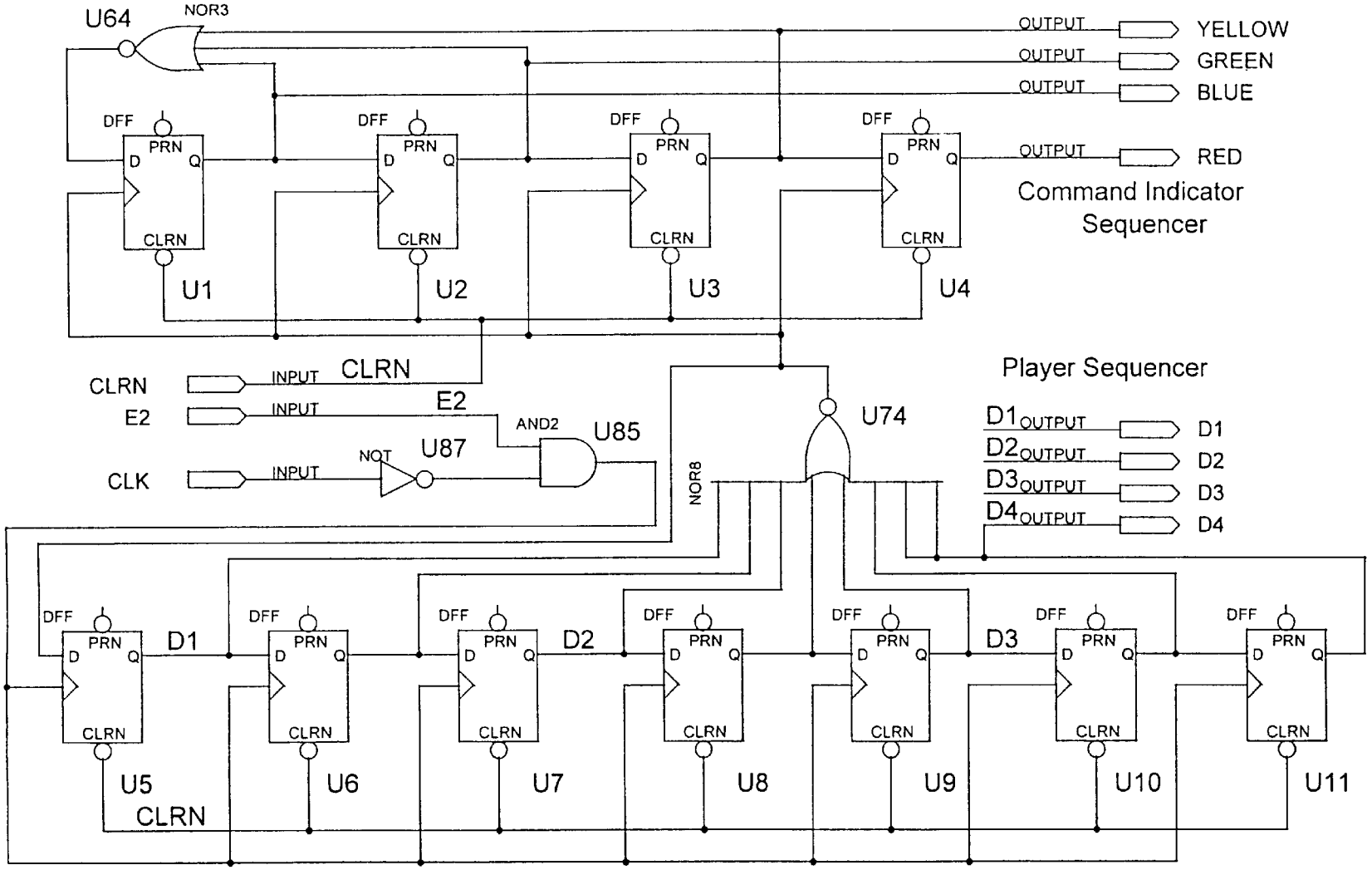
FIG. 3E is a circuit diagram of block SEQUEN.

Sequencers (SEQUEN FIG. 3E):

Player Sequencer;

The Player Sequencer comprises latches U5 through U11 and NOR gate U74 in block SEQUEN (FIG. 3E). When signal CLRN goes low, U5 through U11 are cleared (along with U1 through U4). When signal CLRN goes high all the inputs to U74 are low making the output high. With signal E2 high the next clock pulse will then cause the output of U5 to go high which will cause the output of U74 to go low. With a high on the output and a low on the input of U5 the next clock pulse will cause U6 to go high and U5 to go low. Successive clock pulses will cause the high to propagate down the line until the outputs of U5 through U11 are low. This will put a high on the output of U74 and start the sequence over. Odd outputs of the player sequencer are used to select one of the active players in game levels two and three.

Command Indicator Sequencer;

The Command Indicator Sequencer (comprising U1 through U4 and U64 in block SEQUEN) operates in the same way as the Player Sequencer. As the outputs of U1 through U4 go high sequentially, the outputs RED, YELLOW, GREEN, and BLUE are brought high to provide power for the command indicator LEDs 26R, 26Y, 26G, and 26B. When a GO signal is received, output E2 going low completes the circuit to illuminate the LED. The Command Indicator Sequencer is clocked by the output of U74 in the Player Sequencer.

Output Selector (OUTSEL FIG. 3F):

The Output Selector comprises latches U12 through U15, AND gates U30 through U37, OR gates U38 through U41, NOR gates U51 through U54 (FIG. 3F) and the response switches 16R, 16Y, 16G, and 16B of each player's section 10A, 10B, 10C, and 10D connected, through pole 1 of switches 14L and 14R, to inputs IN1 through IN4. (FIG. 2). When the Command Indicator Sequencer selects a RED, YELLOW, GREEN, or BLUE output from electronics package 20, it energizes all players' response switches of that color.

Again, describing section 10A, at game level one with input NEW low, signal F1 (output of AND gate U66 in FIG.

Figure 3F:
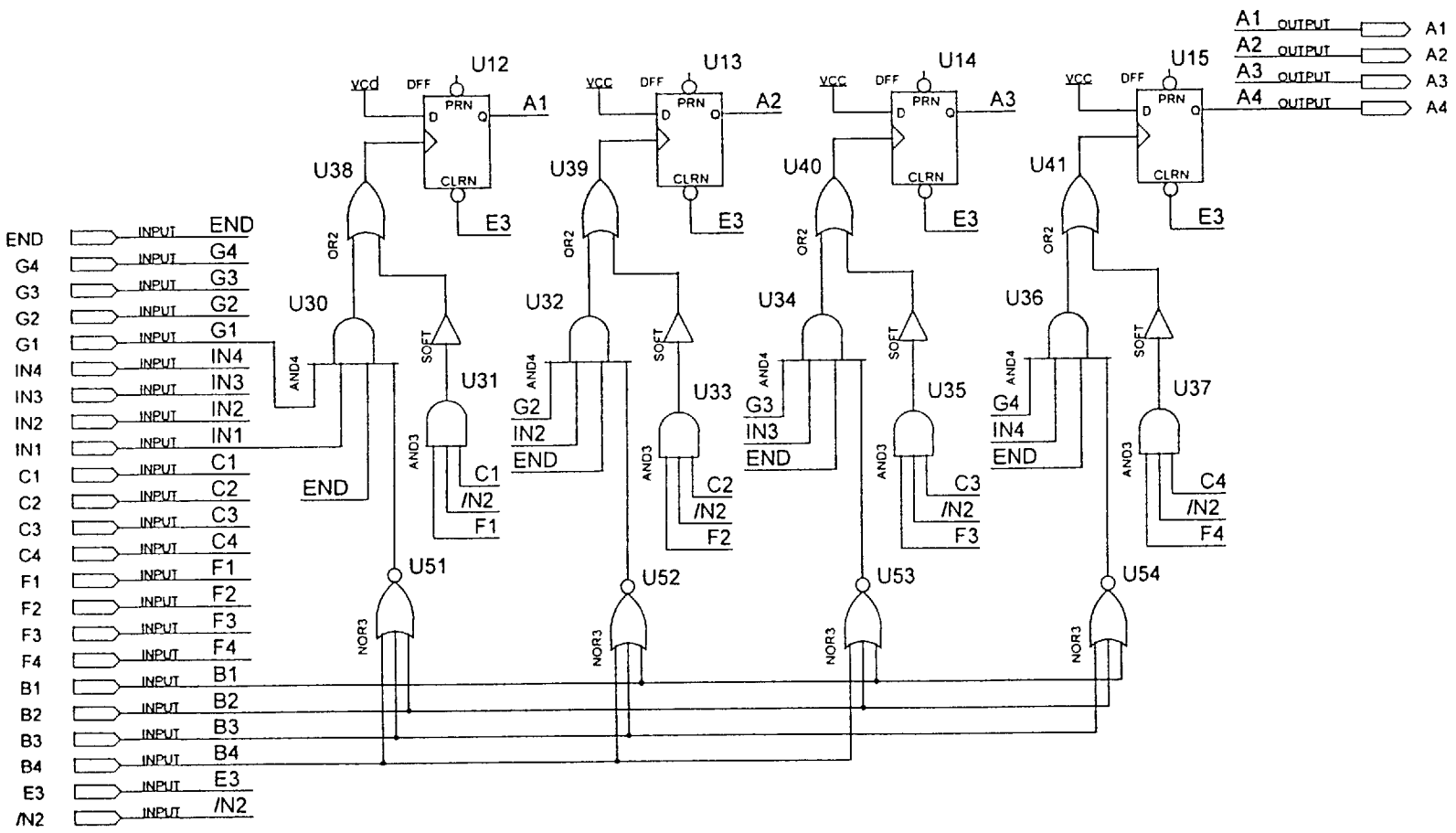
FIG. 3F is a circuit diagram of block OUTSEL.
Figure 3G:
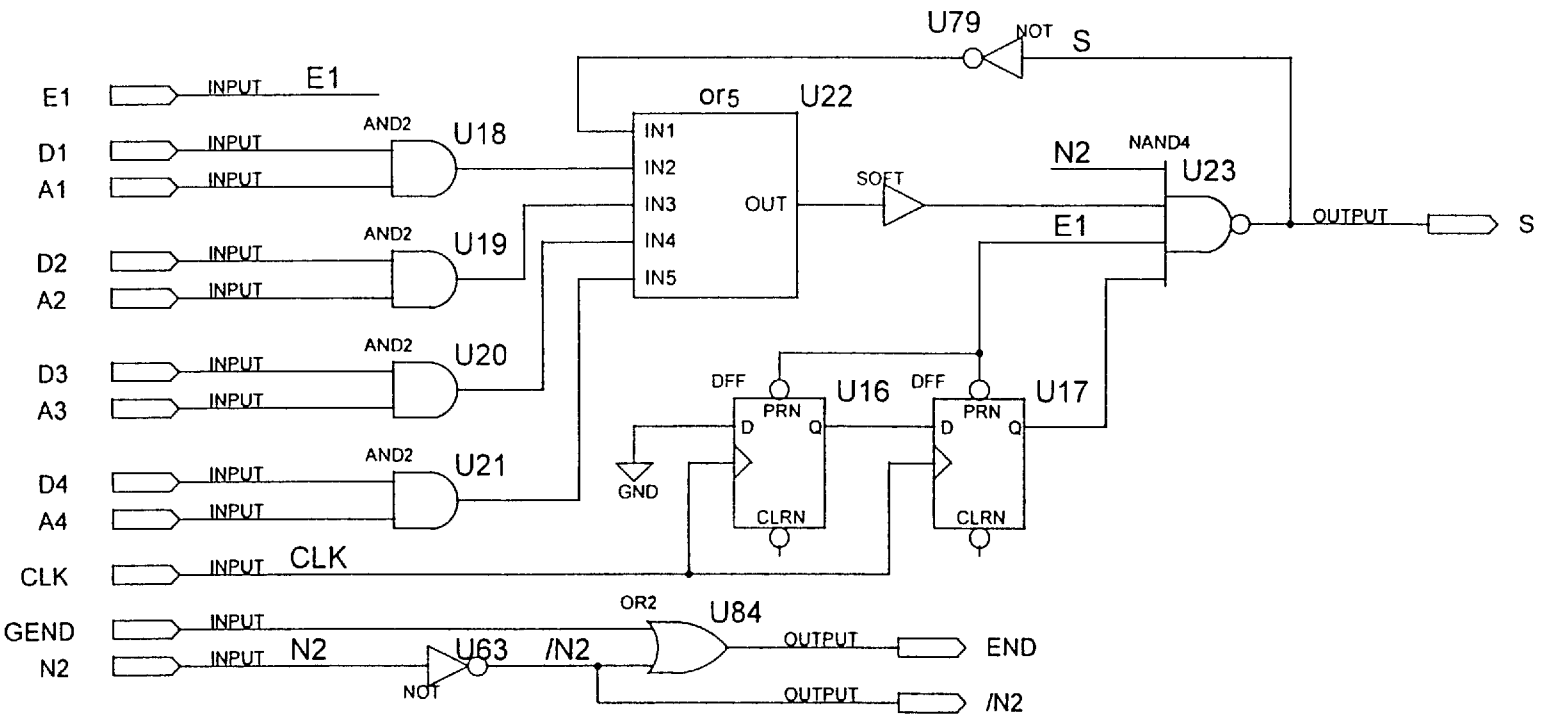
FIG. 3G is a circuit diagram of block RESET.

3D) will always be low holding the output of AND gate U31 (to latch U12 in FIG. 3F) low leaving AND gate U30 as the active gate. With signal GEND high, signal END (output of OR gate U84 in FIG. 3G) will always be high, the output of NOR gate U51 (FIG. 3F) will be high, and signal G1 (output of OR gate U29 in FIG. 3B) will be high if either or both switches 14L and 14R (FIG. 2) are closed. Signal IN1 will be low holding the output of U30 low (FIG. 3F). Once a command indicator LED 26R, 26Y, 26G, or 26B has been chosen and a GO signal received, signal E3 will go high to enable latches U12, U13, U14 and U15. When the player at section 10A closes the energized switch with the correct hand it puts a high on input IN1 clocking latch U12 (FIG. 3F) high. If instead, another player is first to respond correctly, the output of U51 will go low to prevent a high on input IN1 from triggering U12.

Signal A1 (the latched output of U12) is applied through XOR gate U67 and AND gate U80 to output B1 in FIG. 3D to energize the player's response indicator 18A (FIG. 2). Signal A1 is also applied to the NOR gates (U52, U53, and U54 in FIG. 3F) of the other players. The NOR gates then inhibit the other latches from operating. Signals A1, A2, A3, and A4 (the outputs of latches U12, U13, U14, and U15 respectively) are also applied to AND gates U18, U19, U20, and U21 (FIG. 3G) for use in game level 3.

RESET (FIG. 3G):

RESET is used only in game level three. With input N2 high, inputs D1, D2, D3, and D4 will go high sequentially as selected by the player sequencer (in the block SEQUEN) Input A1, A2, A3, or A4 will go high when the selected player responds properly. A high on an A input with a high on a matching D input will bring the output of the corresponding AND gate (U18, U19, U20, or U21) high and the output of OR gate U22 high. Input E1 going low presets U16 and U17 outputs high. When E1 goes back high with N2 high, output S will go low to reset inputs A1, A2, A3, A4, D1, D2, D3, and D4. Output S will be held low through U79 until two clock pulses set U16 and U17 outputs low.

Conclusion, Ramifications and Scope

Thus it can be seen that the described invention can provide an action board game requiring total concentration, instant complex decisions, and immediate action in a competitive environment with little or no reliance on luck. While the above description contains many specificities, these should not be construed as limitations on the scope of the invention, but rather as an exemplification of a preferred embodiment thereof.

Various other embodiments are also possible. For instance, command indicators can be colored lights or shapes or different shapes of different colored lights requiring one hand for the shape and one hand for the color, a single indicator with changing colors, different shapes with changing colors, or any other method of indicating change. The response switches would be designed to match the command indicators. Response indicators could be different colors for different sections. The game board could be any shape from triangular to round with any number of players. The player sequencer can be made to select a player each round or to skip one or more rounds without selecting a player.

Accordingly, the scope of the invention should be determined not by the embodiments illustrated, but by the appended claims and their legal equivalents.

I claim:

1. An action board game comprising:

(A) a power source;

(B) a plurality of visually perceptive indicators used as command indicators;

(C) two or more players sections each containing a plurality of response switches corresponding to said command indicators, one or more ready switches, and a visually perceptive indicator used as a response indicator;

all wired to;

(D) control circuitry including a Ready circuit, a Clock Pulse Generator, a Command Indicator Sequencer, a Go circuit, and an Output Selector circuit such that when said power source is switched on and said ready switches are closed said Ready circuit will cause said Clock Pulse Generator to step through said Command Indicator Sequencer until stopped by said Go circuit thereby energizing one of said command indicators at random and enabling said Output Selector circuit to energize the response indicator on the first player's section to have closed the response switch corresponding to said energized command indicator.

2. The action board game as described in claim 1 with two ready switches connected so that one must be held closed for some responses and the other must be held closed for other responses.

3. The action board game as described in claim 1 with said control circuitry connected such that two or more players' sections are combined to act as one section.

4. The action board game as described in claim 1 with a second sequencer included to occasionally select one player, at random, at the same time that the Command Indicator Sequencer selects a command indicator.

5. The action board game as described in claim 4 with said Output Selector connected so as to de-select a selected player if said player should respond.

6. The action board game as described in claim 4 with two ready switches wired so that one must be held closed for some responses and the other must be held closed for other responses.

7. The action board game as described in claim 4 with said second sequencer included to always select one player, at random, at the same time that the Command Indicator Sequencer selects a command indicator.

8. The action board game as described in claim 7 with said sequencer connected so that one player is selected at random and must respond within a time limit.

* * * * *